US006402337B1

(12) United States Patent
LeVasseur et al.

(10) Patent No.: US 6,402,337 B1
(45) Date of Patent: Jun. 11, 2002

(54) INTERCHANGEABLE BOLLARD STYLE FIXTURE WITH VARIABLE LIGHT PATTERN

(75) Inventors: Craig LeVasseur, Camarillo; Terry Bridges, Westlake Village, both of CA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/578,080

(22) Filed: May 23, 2000

(51) Int. Cl.[7] ..... E01F 9/00

(52) U.S. Cl. ..... 362/153.1; 362/288; 362/277; 362/285

(58) Field of Search ..... 362/153.1, 431, 362/414, 280, 323, 449, 187, 188, 277, 319, 359, 285

(56) References Cited

U.S. PATENT DOCUMENTS 4,438,484 A * 3/1984 Winden ..... 362/267
4,839,782 A * 6/1989 Sikora ..... 362/363
4,984,139 A * 1/1991 Goggia ..... 362/153.1
4,999,749 A * 3/1991 Dormand ..... 362/153.1
5,055,987 A * 10/1991 Ellson et al. ..... 362/277
5,068,773 A * 11/1991 Toth ..... 362/386
5,072,345 A * 12/1991 Goggia ..... 362/153.1
5,075,833 A * 12/1991 Dormand ..... 362/376
5,541,362 A * 7/1996 Reinert, Sr. ..... 174/37
5,594,201 A * 1/1997 Reinert, Sr. ..... 174/37
5,608,994 A * 3/1997 Carter ..... 52/156
5,628,558 A * 5/1997 Iacono et al. ..... 362/288
5,785,409 A * 7/1998 Reinert, Sr. ..... 362/153.1
6,045,236 A * 4/2000 Cheng et al. ..... 362/188
6,183,112 B1 * 2/2001 Bomas ..... 362/285
6,256,961 B1 * 7/2001 Byrnes ..... 52/736.4

* cited by examiner

*Primary Examiner*—Sandra O'Shea
*Assistant Examiner*—Jacob Y. Choi
(74) *Attorney, Agent, or Firm*—John E. Wagner; Sam Bernardo

(57) ABSTRACT

A bollard style light fixture, which allows the user to vary the fixture's light distribution pattern, while also eliminating the fixture's emission of glare. The fixture of this invention is also designed to absorb a minor amount of shock without damage, and provides a mechanism whereby the fixture may be quickly and easily leveled and releveled even after installation. The fixture of this invention comprises a base; a compressible base pad upon which the base rests; a support sleeve vertically extending from the base; a light source located within the support sleeve; a light-emitting window located on the support sleeve opposite the base; and an adjustable cap assembly located atop the light-emitting window vertically adjustable for variably covering the light-emitting window, thus varying the light distribution pattern of the fixture and redirecting the light rays towards the ground, eliminating glare.

27 Claims, 10 Drawing Sheets

63
65
61
60

40L
41
47
45
44
43
46S
40
35
34
36
33
31
30
32
37
36S
17
50
51S

INTERCHANGEABLE BOLLARD STYLE FIXTURE WITH VARIABLE LIGHT PATTERN

FIELD OF THE INVENTION

This invention is in the field of outdoor lighting and particularly in the field of upstanding bollard type fixtures for walkway and related applications.

BACKGROUND OF THE INVENTION

A continuing need exists for free standing lighting fixtures for outdoor use, which are not only effective in providing lighting for walkways and other locations, but are necessarily attractive, rugged enough to withstand not only weather but possible damage from passersby, animals or service and maintenance personnel. The fixture needs to be easily installed and maintained, as well.

Another requirement which is important to the manufacturer, the architect, the landscape lighting designer, and the location owner is the requirement that different size fixtures and types of lamp be selected for use within the same appearance fixture, depending upon the requirements of the overall lighting plan. Heretofore, such varying requirements have often times required the selection of different style fixtures for different locations on the same site.

It has also been found that the actual light distribution pattern and intensity of an outdoor fixture is only really determined during or after installation when little can be done to change the installed fixture.

Bollard-type light fixtures of the prior art have been used for years as a fixture for outdoor use, these style fixtures are attractive and somewhat durable.

Unfortunately, such fixtures emit glare, which observers and passersby find objectionable. Depending upon the fixture location, the glare may also lessen the overall beauty of an illuminated area. In those cases where dissatisfaction over the glare occurs after installation, little can be done. In still other cases, bollard style light fixtures may not be considered as a viable fixture for a project because of concerns over glare.

Bollard-style fixtures rise above the landscape anywhere from two to about three feet, making them easy to bump into. The prior art bollard-style fixtures were not designed to be durable enough to withstand contact from passersby, animals, and service and maintenance personnel without usually sustaining damage as a result of that contact.

Even in those circumstances where the prior art bollard did not incur damage as a result of being struck, such contact often times had the affect of causing the fixture to lose its level and tilt. This tilt is especially obvious at night when the fixture is illuminated. Heretofore, there was no simple means in which to relevel the fixture and eliminate the distracting tilt.

Lastly, the light dispersion pattern of the prior art bollard style fixture is fixed, and once installed, cannot be altered. This fact can be especially troublesome as the lighting needs of the property change with time or with ownership.

It would be beneficial to landowners, architects, and landscape designers to produce an outdoor bollard style light fixture with the following characteristics:

a) durable, waterproof, and rugged in the face of the elements and abuses from passersby, animals, and service and maintenance personnel;

b) a fixture in various sizes;

c) a fixture which is easily installed and maintained;

d) a fixture which can accommodate various types of lamps, allowing for a lighting plan to include different lighting levels, patterns, and intensities, while maintaining the beauty and consistency of using only one style fixture;

e) a light fixture which would provide the owner the ability to alter the light distribution, pattern and intensity as often as is desired, without the need to replace or modify the fixture once installed;

f) a fixture which is designed to absorb minor shock when contacted by foreign objects, animals or passersby;

g) a fixture which is easy to level during installation and can be releveled even after installation; and finally h) a bollard-style light fixture which will not emit glare.

BRIEF DESCRIPTION OF THE INVENTION

Form and function are the two most important factors to be considered when deciding on a style and type of lamp for an outdoor fixture. The outdoor fixture should add beauty and safety to those areas where it is installed. This and more is achieved by the bollard style fixtures of this invention.

Faced with the foregoing state of the art, it is a general object of this invention to provide a series of interchangeable bollard-type lighting fixtures, which employ a common basic design and major structural components, but are subject to simple change of electronic components, lamp types and sizes, and with the light pattern simply adjusted before or after installation.

A further object of this invention is to provide a bollard type fixture which substantially reduces, if not, eliminates glare.

Another object of this invention is to provide such a series of bollard-type fixtures, which are easily installed in a foolproof manner with a high degree of simplicity and reliability.

Yet another object of this invention is to provide a bollard-type fixture which is virtually waterproof.

Still another feature of this invention is to facilitate inspection and repair or replacement of any component which so requires without disturbing the installation base and the power supply lines.

One additional feature of this invention is to provide for simple beam pattern adjustment after installation to match the desired illumination field.

Yet another feature of this invention is to provide a fixture wherein the fixture is capable of absorbing minimal amounts of shock or force with little or no damage.

A final feature of this invention is the ability of the owner or maintenance personnel to quickly and easily level and relevel the fixture even after installation.

Each of these features are accomplished in the embodiments of this invention, which comprises a mounting base for securing the bollard fixture to the ground or other support surface, a sealed feed for the entrance of power leads, a lamp and electronics, and an electrical component support bracket.

The mounting base supports an external sleeve, which constitutes the major body of the fixture. At the upper end region is a solid transparent window, which constitutes the light-emitting surface of the fixture. An opaque cap completes the bollard fixture in its basic form.

The mounting base rests upon a compressible material, such as neoprene. The neoprene absorbs minor forces exerted upon the fixture, and provides service or maintenance personnel with the ability to level and relevel the fixture by compressing the neoprene base through tightening one or more of the fixture's anchor bolts.

The support bracket is basically in the form of a hollow rectangle with sides of length slightly less than the diameter of the circular cross section outer sleeve and the longer sides of the rectangle are shorter than the length of the outer sleeve.

The upper short side of the rectangular support structure serves as a mount for the lamp and its socket. At the lower short side of the rectangular support bracket emerge the lamp assembly leads to be secured by wire nuts or other electrical connector to the incoming power leads reaching the fixture through the weather seal provided by the lower seal.

The support bracket with its electronics or electrical elements, mounted within the hollow rectangle and the lamp and its socket may be interchanged to provide the type of lighting sought, e.g., halogen or H.I.D., each with their different characteristics and intensity.

In accordance with the need to reduce glare and to vary the fixture's light distribution pattern, the inventors have, at the upper end of the external sleeve and above the solid transparent light-emitting window, incorporated an adjustable sleeve cap assembly comprising an internal sleeve, an external adjustable sleeve cap and a protective external sleeve cap lid for access into the assembly.

The adjustable sleeve cap assembly virtually eliminates the emission glare by the H.I.D. or halogen lamp bollard style light fixture by redirecting the fixture's light rays downward and away from the eyes of the observer. Further, this same assembly allows the fixture owner the flexibility of quickly and easily varying the light distribution patterns of the fixture. The adjustable sleeve cap assembly may be vertically adjusted, and such adjustment controls the beam pattern of the light-emitting window by allowing the adjustable sleeve to cover a greater or lesser portion of the transparent light-emitting window.

Adjusting the beam pattern of light is achieved by adjusting the external adjustable sleeve cap to the desired setting in order to achieve the desired lighting condition, locking the external adjustable sleeve in place relative to the internal sleeve with a locking device, and replacing the protective external adjustable sleeve cap lid.

Thus, a significant feature of the bollard style fixture of this invention are the elimination of the fixture's emission of glare, and the ability of the owner to quickly and easily vary the fixture's light distribution pattern after installation.

Another significant feature of the fixture is the fixture's ability to absorb minor amounts of shock without damage. Finally, the fixture can be quickly and easily leveled and releveled, even after installation.

BRIEF DESCRIPTION OF THE DRAWINGS

This invention may be more clearly understood from the following detailed description and by reference to the drawings in which:

FIG. 1 is comprised of FIGS. 1*a* and 1*b*.

FIG. 2 is comprised of FIGS. 2*a*, 2*b* and 2*c*; FIGS. 2*a* and 2*b* are front elevational views of one embodiment of this invention, while FIG. 2*a* depicts the adjustable sleeve cap assembly in a fully-raised position, while FIG. 2*b* illustrates the adjustable sleeve cap assembly in a partially-raised position; FIG. 2*c* illustrates the various light dispersion patterns achieved by adjusting the position of the adjustable sleeve cap.

FIG. 3 is comprised of FIGS. 3*a* and 3*b;*

DETAILED DESCRIPTION OF THE INVENTION

The bollard style outdoor light fixture of this invention is designed to provide low level general illumination to pathways, driveways, steps, patios, gardens, and the like, without the emission of glare and with the added feature of varying the fixtures light distribution pattern after installation.

The bollard style fixture of this invention, commonly referred to as a big bollard comes in two basic sizes, the 24 inch high bollard, and the 30-inch bollard. The bollard style outdoor light fixture comes in a variety of exterior surface finishes and, therefore, can be designed to accommodate almost any lighting theme.

Figures 1A, 1B:
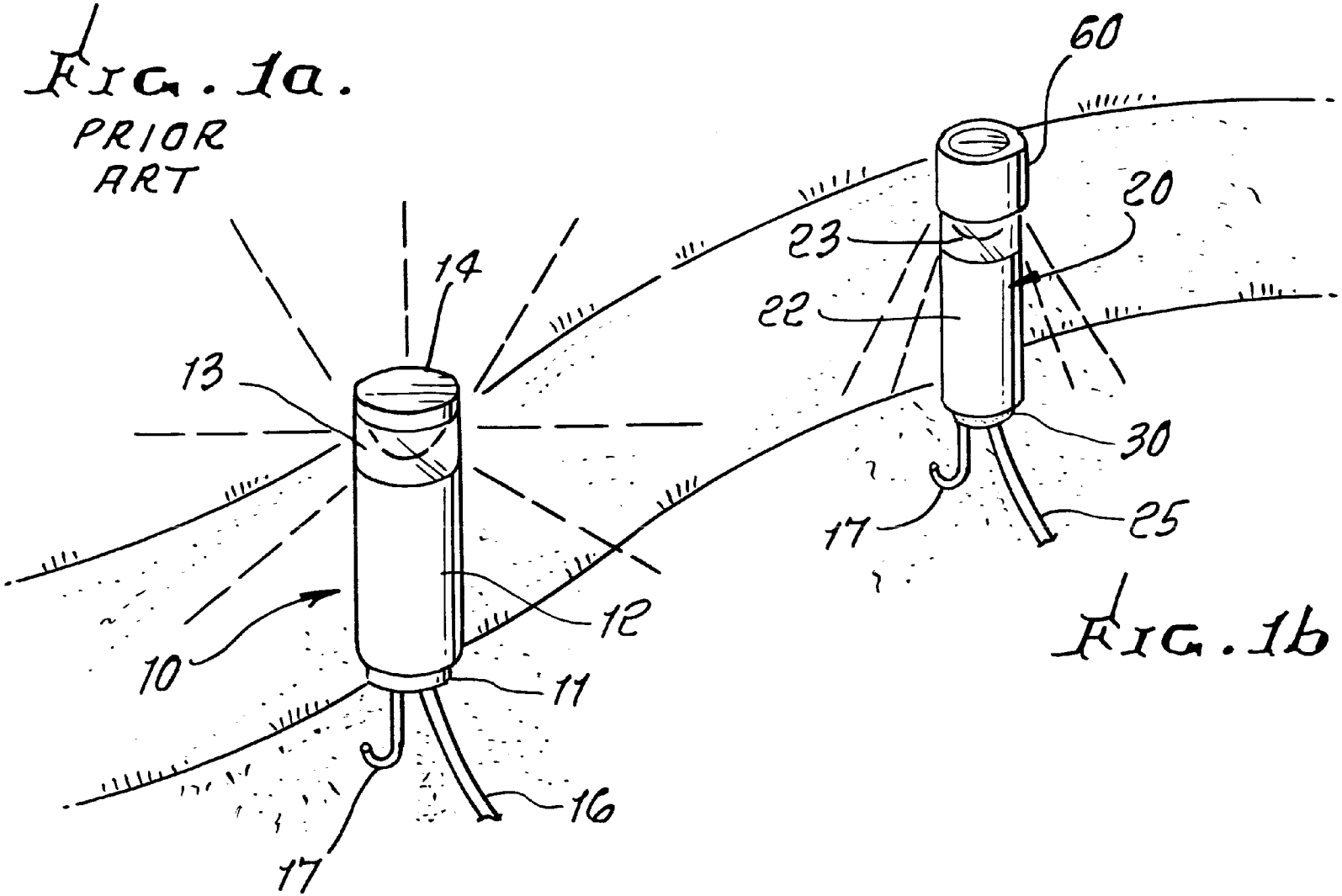
FIG. 1a. PRIOR ART
FIG. 1*a* is a perspective view of the prior art bollard style light fixture.
FIG. 1*b* is a perspective view of the bollard style light fixture of this invention.

Referring now to the drawings in general, and in particular to FIGS. 1*a* and 1*b*. FIG. 1*a* illustrates the prior art standard bollard style light fixture 10, with a mounting base 11, an external sleeve 12, a light-emitting window 13, a cap 14, a power feed 16, and a base anchor 17.

The prior art bollard style light fixture emits an undesirable glare, as shown by the broken lines, to observers and to passersby by directing the light from the lamp (not shown) into the observer's eye. The intensity of the glare may vary to some degree by the choice of lamp; however, it cannot be effectively eliminated in the prior art fixtures. Once installed, the prior art bollard's emission of an objectionable glare cannot be remedied without taking drastic measures. Replacement of the prior art bollard style light fixture with another style fixture may provide the landowner with the only available remedy for eliminating the glare given off by the bollard fixture within the illuminated area. Such replacement is expensive, wasteful, and would destroy the uniformity of a single fixture style lighting theme.

FIG. 1*a* also depicts the prior art bollard style fixture's fixed light dispersion characteristic, also as shown by the broken lines. After installation of the prior art bollard, the fixture's light dispersion characteristics cannot be altered, for example, to accommodate for a change in the desire to highlight a specific area or the desire to change the lighting mood of the illuminated area by increasing or decreasing the light dispersion characteristics of the fixture. Once again, replacement of the fixture may be the only way in which to vary the light dispersion pattern in the illuminated areas. Finally, FIG. 1*a* illustrates a fixture whose base is rigid.

FIG. 1*b* illustrates a bollard style light fixture 20 of this invention, comprising a mounting base assembly 30, an external sleeve 22, a light-emitting window 23, a lamp with electrical components (not shown), a power feed 25, three base anchor bolts 17 (only one of which is shown), and an adjustable sleeve cap assembly 60.

A comparison of FIG. 1*a* with FIG. 1*b* reveals that the prior art bollard style fixture 11 and the inventive bollard style fixture 20 to be near identical in size and shape. Maintaining the same general appearance of the prior art bollard was a significant consideration in the design of the fixture of this invention. Thus, the timeless beauty of the bollard style fixture has not been destroyed in improving the fixture. This consistency in appearance allows the owner of a prior art bollard the freedom to accent a special area with the installation of an inventive bollard fixture 20, while maintaining the same fixture style theme.

Through the use of a bollard fixture of this invention, the owner of an outdoor light fixture has the flexibility of choosing a single fixture style, which can vary in external finish, vary in the type of lamp, vary in light distribution characteristics, and illuminate the desired area without the emission of any unwanted glare. The fixture is also designed to absorb minor amounts of shock without damage and can be releveled, even after installation. Remarkably, all of this can be achieved with the bollard style fixture of this invention. Such flexibility allows the owner, designer and installer of this style fixture the freedom to utilize but a single style fixture when creating an overall appearance theme.

FIGS. 1*b,* 2*a,* 2*b,* and 2*c* clearly illustrate one of the benefits of this invention, the elimination of unwanted glare, which is not only bothersome to observers and passersby, but also detracts from the overall beauty of the illuminated area.

A portion of the external sleeve cap assembly 60 extends outward slightly from the light-emitting window 23, such that the light rays emanating from the fixture's lamp (not shown) are redirected downward and away from the observer's eye, thus eliminating the fixture's emission of glare.

The light distribution pattern, as shown in of FIGS. 1*b,* 2*a,* 2*b,* and 2*c* is directed downward, as shown by the broken lines, and does not result in the emission of any upward directed glare and provides variable size 360° illumination pattern on the surface surrounding the fixture.

Figures 2A, 2B:
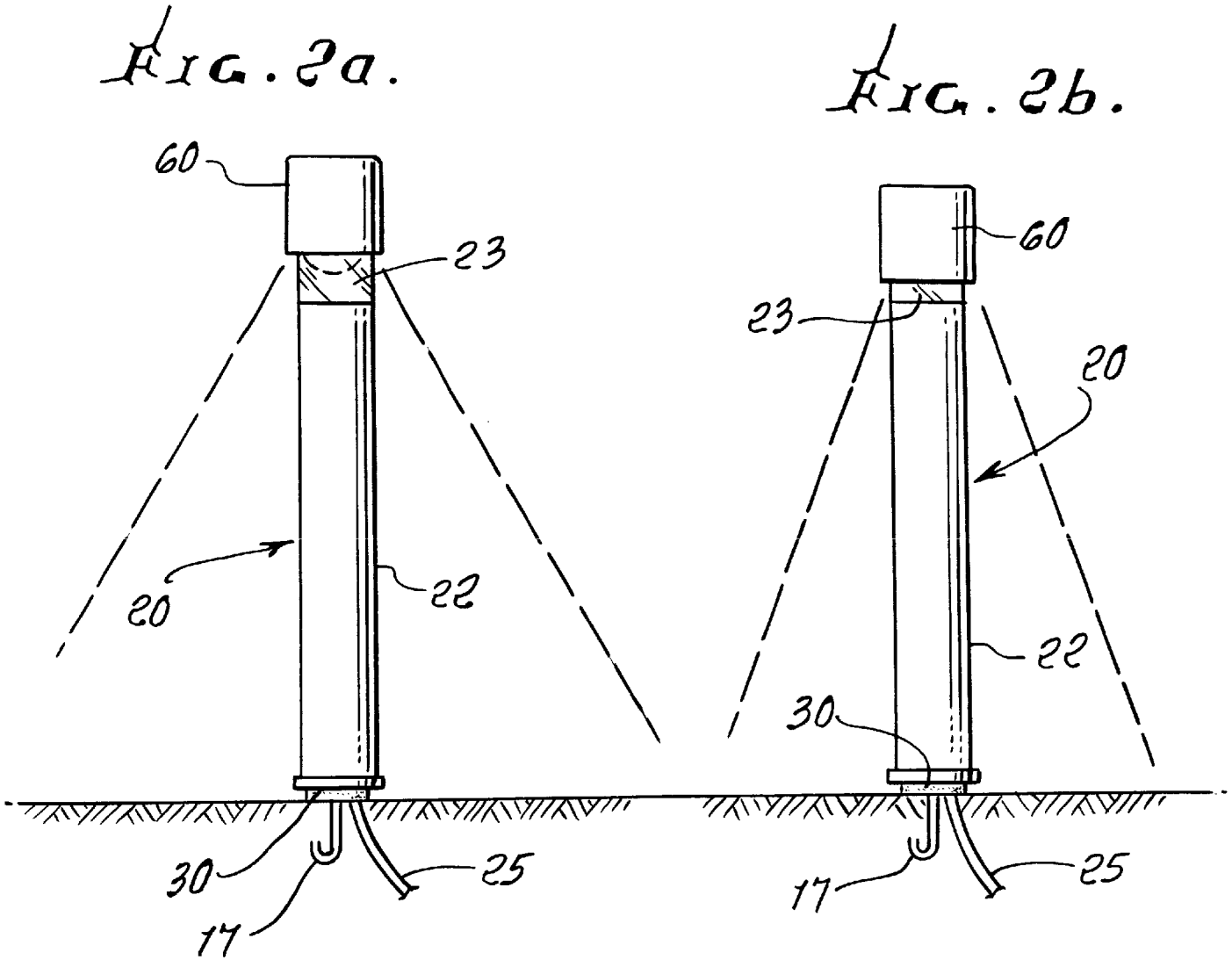
Figure 2C:
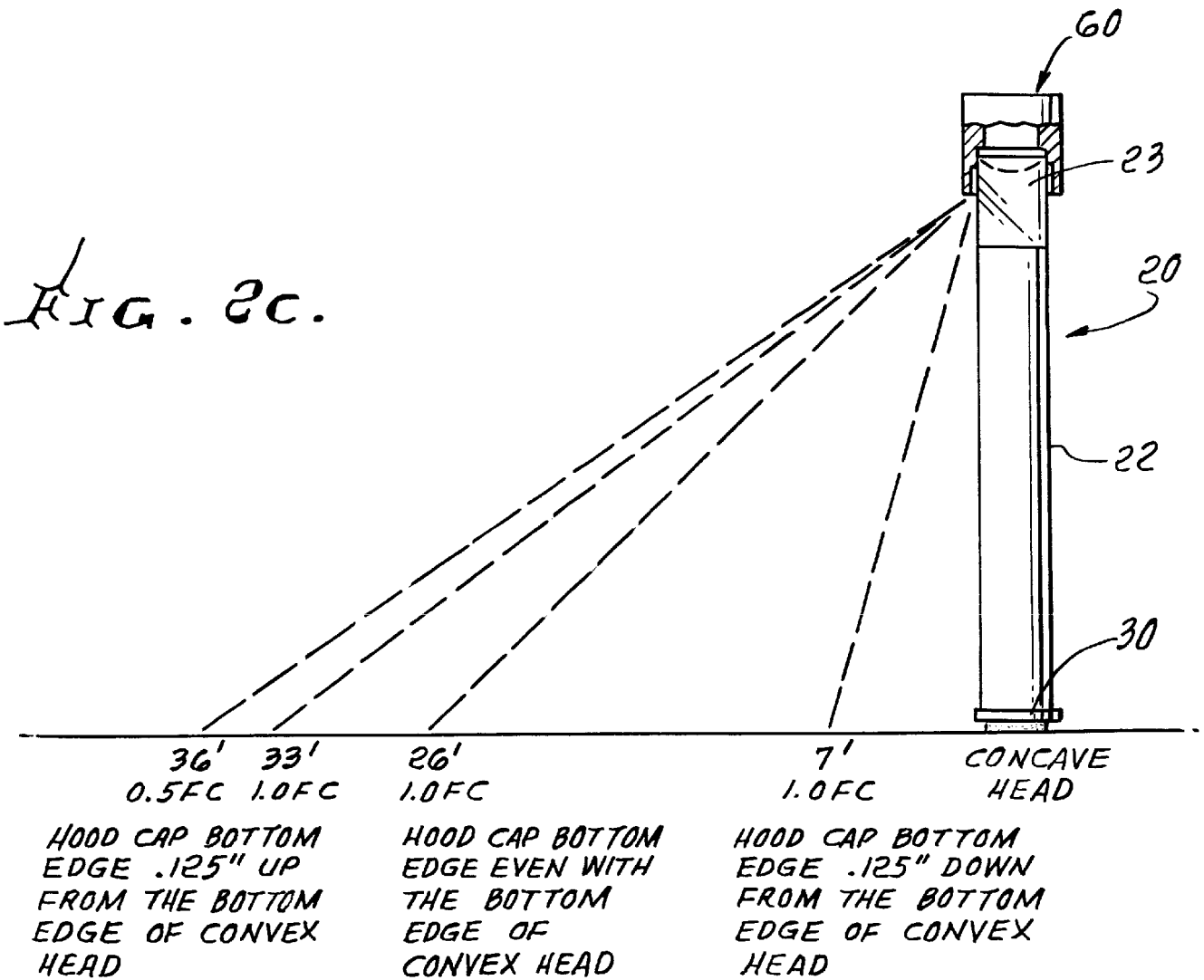
FIG. 2*c* is a side elevational longitudinal view, partially in section, of the same embodiment of this invention.

FIGS. 2*a,* 2*b,* and 2*c* also set forth another benefit of this invention, the ability of the fixture owner or landscape designer to actually vary the fixture's light dispersion pattern after installation, even if installation is permanent. FIG. 2*a* sets forth a bollard-style light fixture 20 wherein the light-emitting window 23 is fully open, while FIG. 2*b* depicts a bollard-style light fixture 20, with the light-emitting window 23 partially covered. By covering a greater or lesser portion of the light-emitting window 23, through use of the external adjustable sleeve cap assembly 60, the light distribution pattern of the fixture is varied, as can be seen from the broken lines in each figure. This aspect of the fixture of this invention is best seen in FIG. 2*c*.

Varying the fixture's light dispersion pattern allows the fixture owner the freedom to alter lighting conditions to accommodate for changes in lighting needs or desires and thus moods. For example, the fixture owner has the flexibility of highlighting a particular area or feature of the property depending on the occasion. Further, the bollard style fixture of this invention is capable of having its light-distribution pattern varied without having to employ either another style fixture or different type lamp, e.g., H.I.D. or halogen.

Figures 3A, 3B:
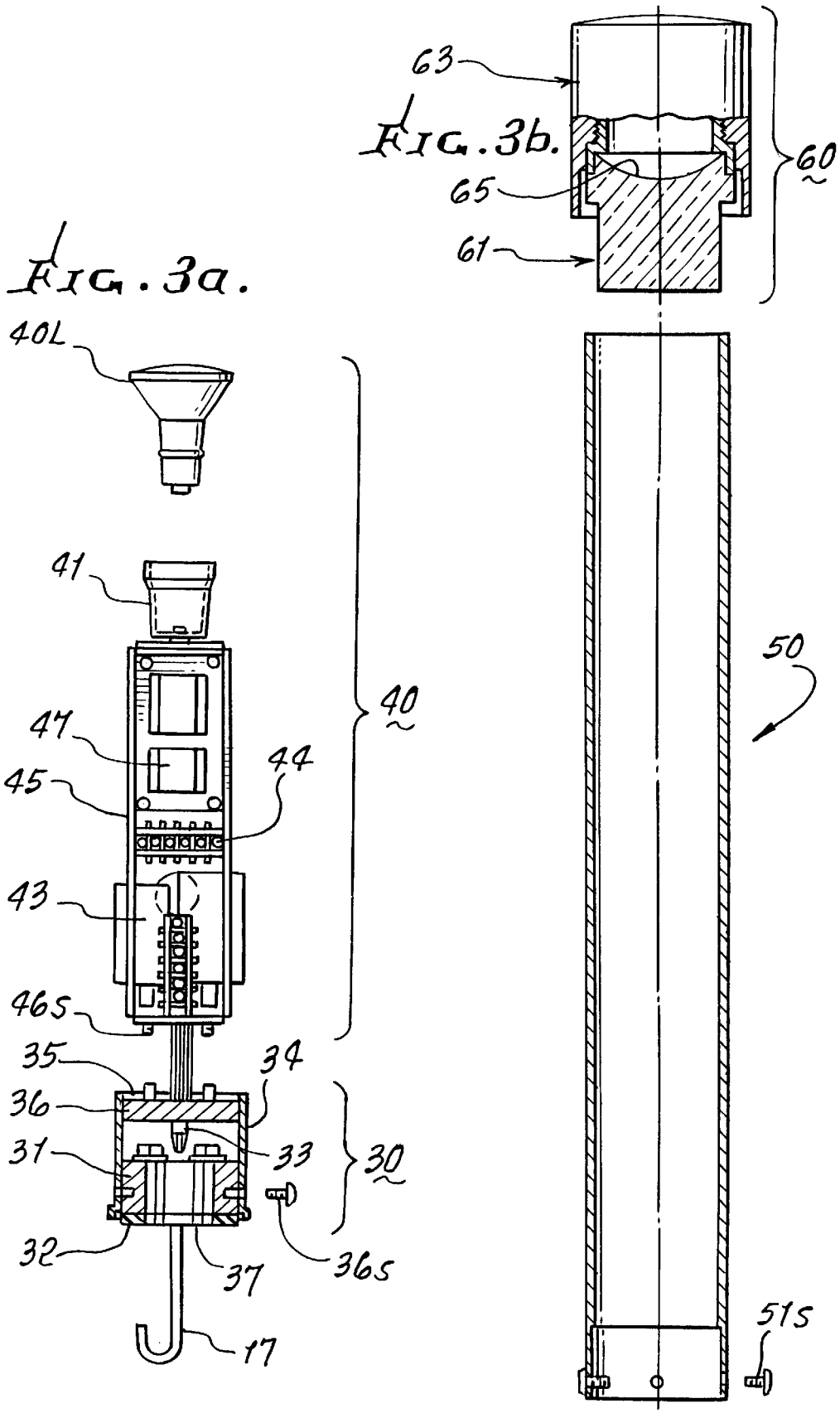
FIG. 3*a* is a longitudinal exploded sectional view of the internal light assembly and base assembly.
FIG. 3*b* is a side longitudinal exploded view of the external sleeve and adjustable sleeve cap assembly.

Now referring generally to FIG. 3, which illustrates the basic elements of this invention. FIGS. 3*a* and 3*b* illustrate the bollard style light fixture of this invention, which is basically comprised of three general assemblies, the base assembly 30, the internal light assembly 40, and the adjustable sleeve cap assembly 60.

Referring generally to FIG. 3*a,* and specifically to FIG. 7 which depicts the base assembly 30, comprised of a cylindrical mounting base 31, a cylindrical base pad 32, three base mounting bolts 17 (only one shown in FIG. 3 and two shown in FIG. 7), a power lead opening 33, a cylindrical interior base sleeve 34, a potting plate 35, potting material 36, and a sealed feed 37.

The mounting base 31, preferably made of 6061 aluminum, sits upon a base pad 32, preferably made of neoprene. The mounting base 31 can be adapted to secure the light fixture to the ground or other support surface. The mounting base 31 and base pad 32, are configured to have openings through their centers through which the power conduit 25 and anchor bolts 17 or other securing means are placed. A sealed feed 37 for the entrance of power leads is introduced at the power lead opening 33 at the bottom of the mounting base 31 and base pad 32.

Another significant advantage of this invention is that the neoprene base pad 32 acts to absorb minor amounts of shock directed towards the fixture. This base pad 32 acts as a "shock absorber" and allows the fixture to withstand minor bumps, strikes and contacts from passersby, service and maintenance equipment, and the like with little or no damage.

Figure 7A:
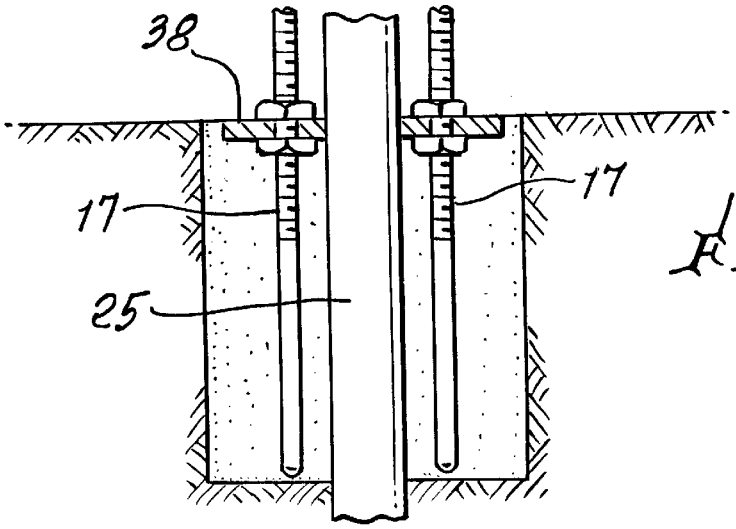
FIG. 7 is comprised of FIGS. 7*a,* 7*b,* and 7*c,* which are side elevational views of the inventive mounting base of this invention in various stages of installation.
Figure 7B:
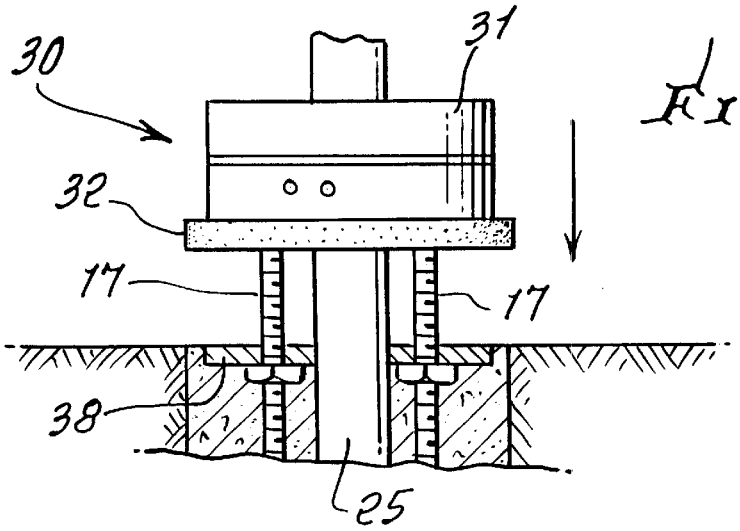

The neoprene base pad 32 also acts as a leveling mechanism as is best seen and described in connection with FIG. 7. FIGS. 7*a,* 7*b,* and 7*c* illustrate how the fixture of this invention is set in, for example concrete, and thereafter leveled.

Turning now to FIG. 3*a,* just above the mounting base 31 is the potting material 36, preferably JEFFCO type 9601, from JEFFCO PRODUCTS, 5252 Kearny Villa Way, San Diego, Calif. 92123, and on top of the potting material 36 is the potting plate 35. The potting material 36 and the potting plate 35 are both designed to allow for the power lead to extend upward through the base assembly 30 to connect with the internal light assembly 40 via wire nuts.

The cylindrical interior base sleeve 34, preferably made of type 6061 aluminum acts to generally enclose the base assembly 30 and is attached to the mounting base 31 by screws 36S.

The H.I.D. internal light assembly 40 is comprised generally of a lamp 40L, a lamp holder or socket 41, a ballast 47, a capacitor 43, and a terminal block 44, all of which are mounted upon and supported by a frame support 45.

Figure 8B:
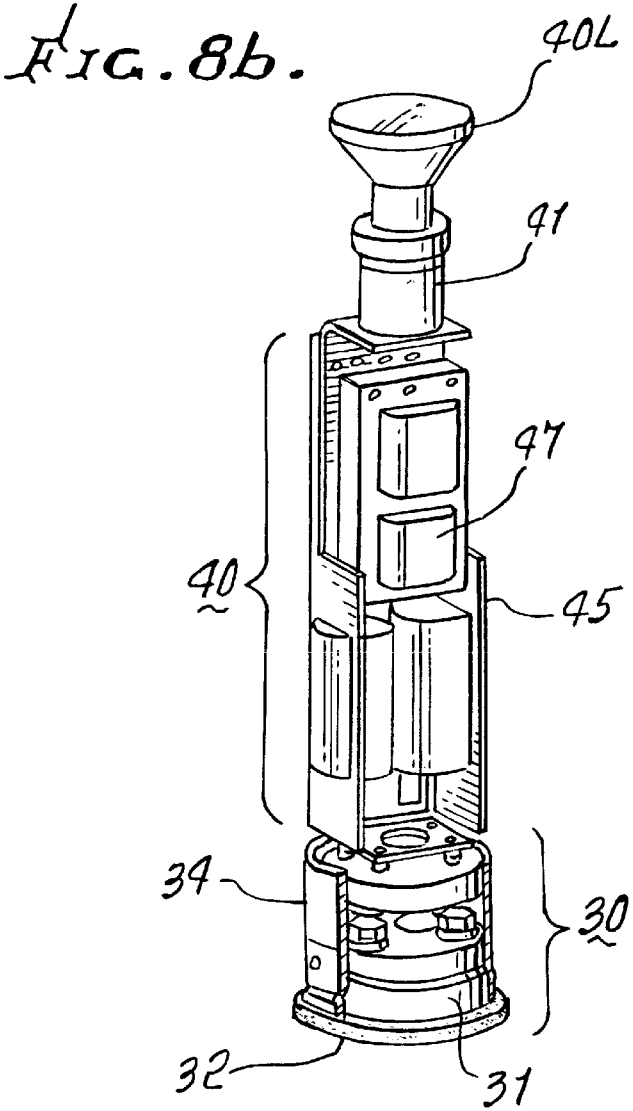
FIG. 8 is a comprised of FIGS. 8*a* and 8*b* which are perspective views comprising the internal light assemblies of the halogen lamp and H.I.D. lamp embodiments, respectively.
Figure 8A:
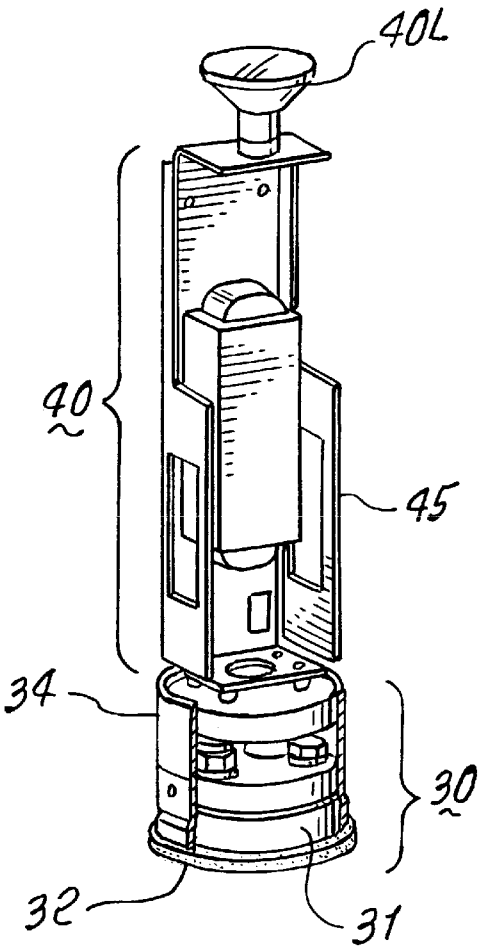

The internal light assembly 40 of this invention can accommodate two different lamp types, H.I.D. FIG. 8*a* or halogen FIG. 8*b*. (H.I.D. is described herein.) Each type of light assembly requires its own specific components and frame support 45 and are configured to allow for easy access for repair or lamp replacement, as is best seen in FIG. 8 and as described below.

The internal light assembly components 40 are attached to the frame support 45 by screws or other fasteners, and the like and the frame support 45 is attached to the mounting base 30 by screws 46S or the like. The conduit lead wires, which come from below the base assembly 30, are connected to potted lead wires with wire nuts.

Turning now to FIG. 3*b,* which illustrates that both the base assembly 30 and the internal light assembly 40 are surrounded and partially enclosed by a cylindrical exterior sleeve 50, which constitutes a major body of the bollard style fixture. The exterior sleeve 50 is preferably made of 6061 type aluminum suitably finished for appearance and is supported by and connected to the mounting base 30 with screws 51S. The bollard external sleeve come in a variety of sizes, e.g., 30 inches and 24 inches, and each is interchangeable with the bollard style fixture of this invention. This identifies still another benefit of this invention, wherein the landowner has the flexibility of increasing or decreasing the height of the light fixture simply by changing the external sleeve 50.

The exterior sleeve end 50 opposite the mounting base 31 supports the adjustable sleeve cap assembly 60. FIG. 3*b* generally illustrates the adjustable sleeve cap assembly 60 in relation to the exterior sleeve 50. FIG. 3*b* depicts the fixture's cylindrical transparent head or lens 61 with its concave face 65 and external adjustable sleeve cap 63.

Figure 4:
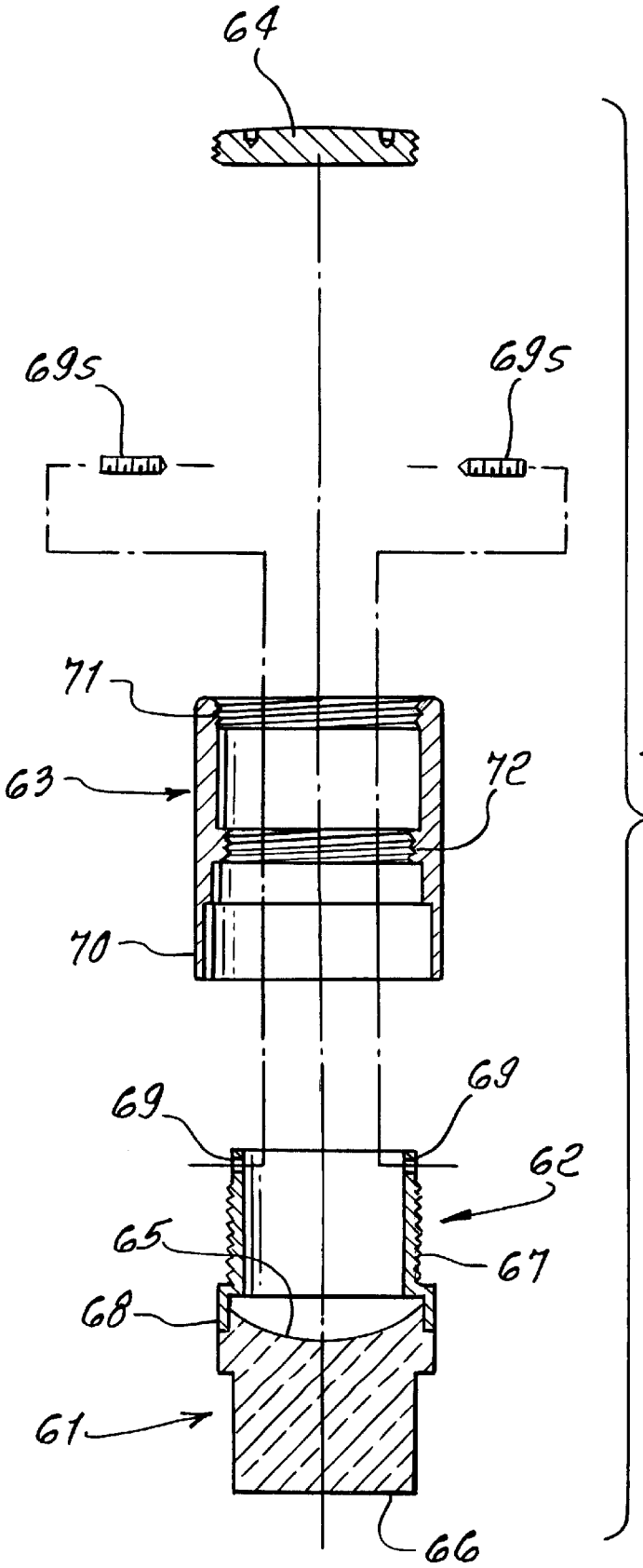
FIG. 4 is an exploded longitudinal sectional view of the sleeve cap assembly of this invention.
Figure 5A:
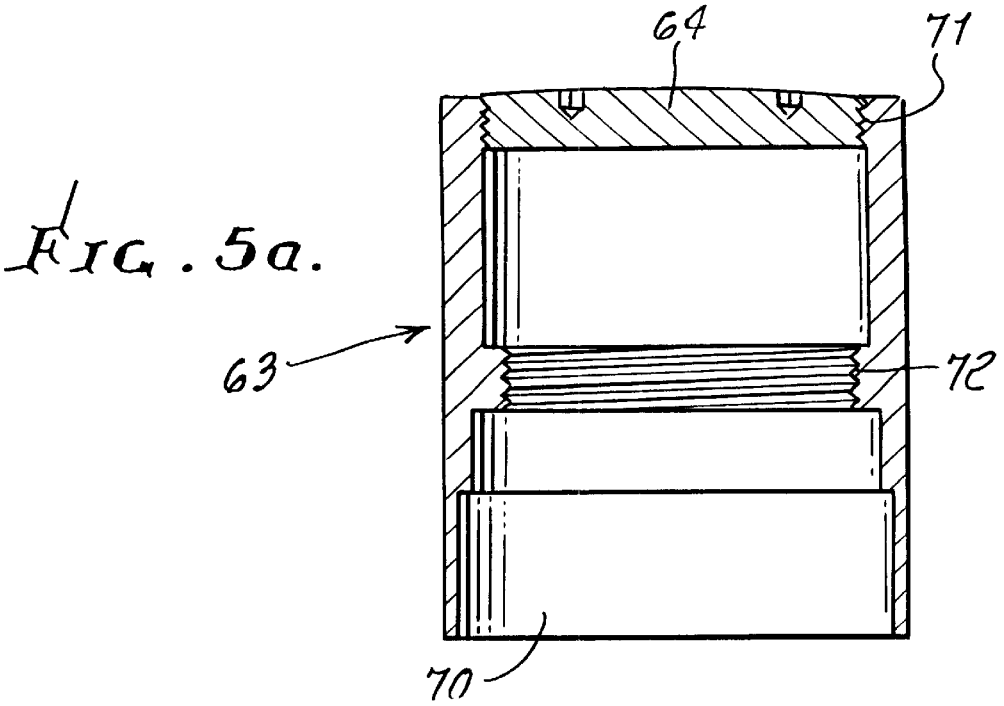
FIG. 5*a* is a longitudinal diametrical sectional view of the external adjustable sleeve cap with lid.
Figure 5B:
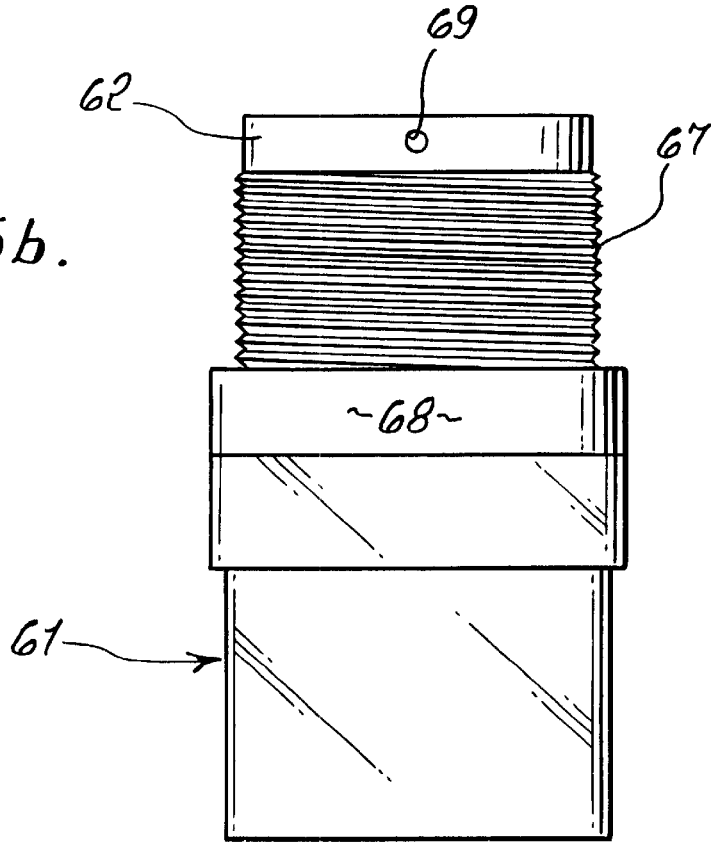
FIG. 5*b* is a elevational view of the internal sleeve of FIG. 5*c* rotated 90°.
Figure 5C:
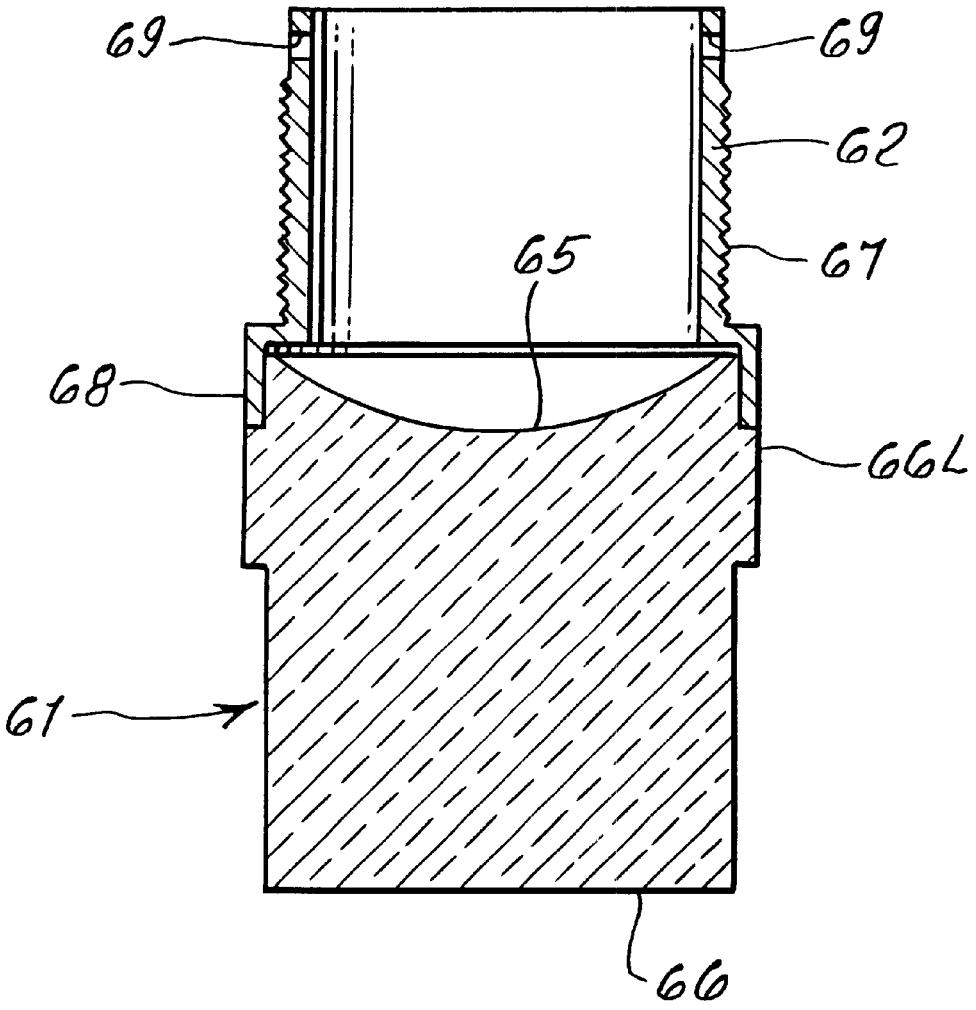
FIG. 5*c* is a longitudinal sectional view of the internal sleeve fixture head and lens assembly.
Figure 6B:
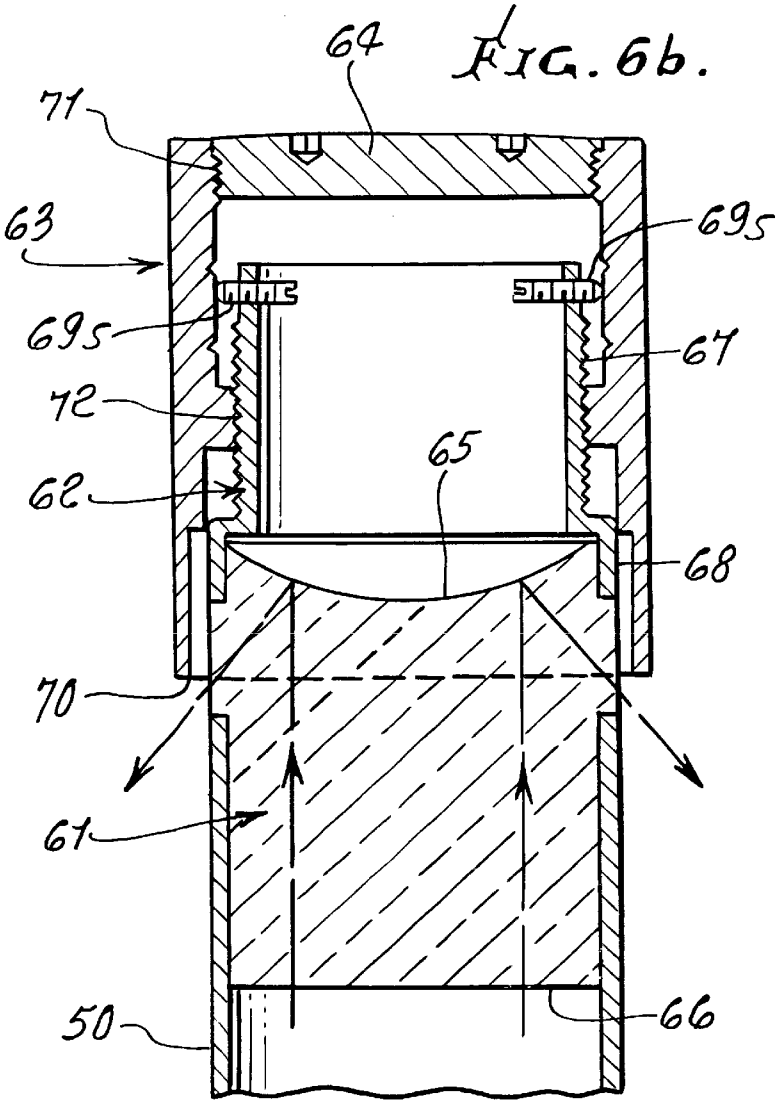
FIG. 6*b* shows the lamp partly open.
Figure 6A:
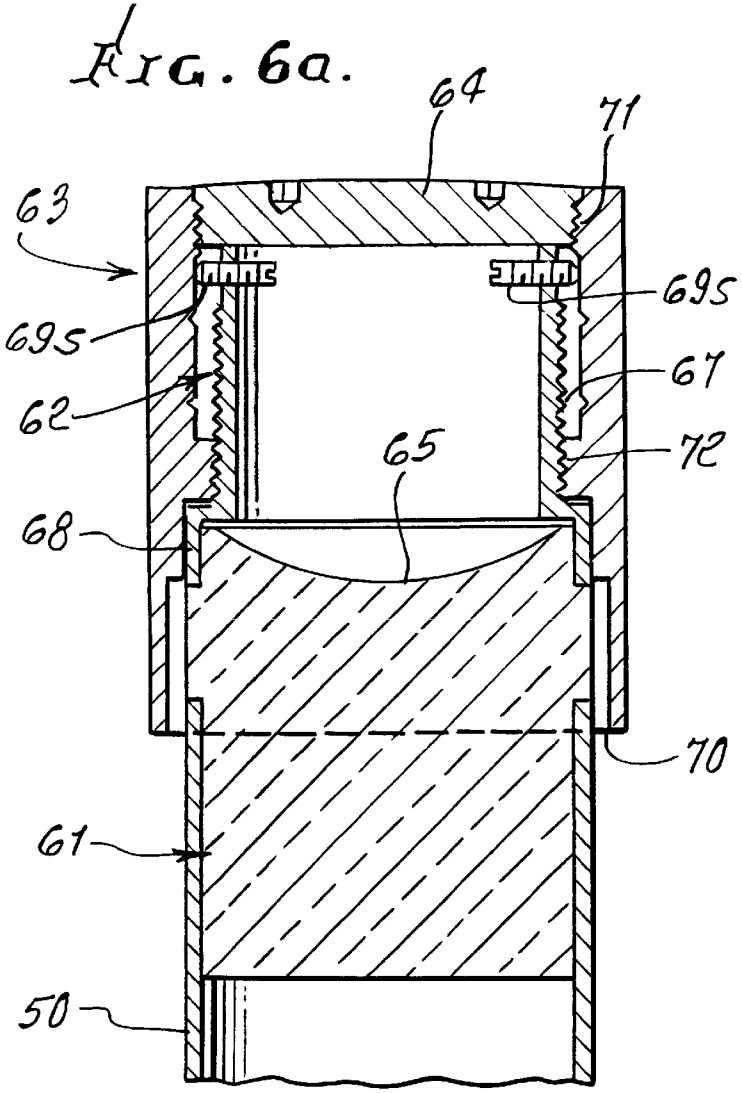
FIG. 6 is comprised of FIGS. 6*a* and 6*b,* both of which are longitudinal sectional views of the adjustable sleeve cap assembly, with FIG. 6*a* showing the lamp virtually closed

The external adjustable sleeve cap assembly 60 is shown in detail in FIGS. 4, 5, and 6. FIGS. 4, 5, and 6 illustrate the cylindrical transparent lens/head 61 having a concave face end 65 and a non-concave face end 66. The cylindrical head 61 is preferably made of UV stabilized acrylic and acts as the light-emitting window for the fixture. The non-concave face end 66 of the cylindrical head 61 is designed to fit onto the end of the external sleeve 50 opposite the mounting base 31 FIGS. 6*a* and 6*b*. The non-concave face end 66 is preferably held in place on the exterior sleeve 50 with an adhesive, such as silicone cement or the like.

The cylindrical internal sleeve 62, is preferably made of 6061 aluminum, and in the preferred embodiment is threaded along its exterior wall 67. Just below the threaded exterior wall 67 of the internal sleeve 62 is a lip 68 which extends away from the exterior wall 67 and is designed to be received by a matching lip 66L of FIG. 5*c* which extends away from the concave face end 65 of the cylindrical head 61. The internal sleeve 62 is held in place on the cylindrical head 61, preferably with silicone cement, or the like, providing a weather tight seal. The threaded exterior wall 67 of the internal sleeve 62 is designed with openings 69, to receive set screws 69S or the like of FIGS. 6*a* and 6*b*. The set screws 69S act to fix the position of the external adjustable sleeve cap 63 relative to the internal sleeve cap 62.

A cylindrical external adjustable sleeve cap 63, preferably made of 6061 aluminum, having two ends, a bottom end 70 designed to fit over the exterior portion of the head 61 and a top end 71 sealed by lid 64. The external adjustable sleeve cap 63 has a threaded interior portion 72 adapted to receive the threaded exterior wall portion 67 of the internal sleeve 62. The external adjustable sleeve cap 63 can be raised or lowered relative to the internal sleeve 63 by advancing the external adjustable sleeve cap 63 along the threads 67 of the internal sleeve 62. The external adjustable sleeve cap 63 also has a top end 71, which is threaded to receive a lid 64.

The lid 64 is generally circular, preferably made of 6061 aluminum, and is threaded to be received by the external adjustable sleeve cap 63. The lid 64 allows authorized individuals access to the internal workings of the adjustable sleeve cap assembly 60, and thus the ability to vary the light distribution pattern of the fixture. The lid 64 also acts to prevent unwanted access into the light fixtures internal settings and completes the adjustable sleeve cap assembly 60.

FIG. 6 depicts the bollard style fixture of this invention in two separate light distribution settings where FIG. 6*a* has the external adjustable sleeve cap 63 in a lowered, virtually closed position, and FIG. 6*b* has the same cap 63 in a partially raised position. FIG. 6*b,* as seen by way of the arrow lines, also illustrates how the adjustable sleeve cap assembly 60 eliminates glare by redirecting the light rays from the fixture's lamp (not shown) towards the ground and away from the eye of the observer.

Once the adjustable bollard light fixture 20 is mounted on the property, a screwdriver is all that is required to vary the fixture's light distribution pattern by way of the adjustable sleeve cap assembly 60 of FIG. 4.

To vary the light distribution pattern of a bollard fixture of this invention, one first removes the lid 64 from the external adjustable sleeve cap 63.

Second, loosen the internal sleeve set screws 69S, so as to allow the external adjustable sleeve cap 63 to move vertically to the desired light pattern.

Once the adjustable bollard light fixture 20 is mounted on the property, a screwdriver is all that is required to vary the fixture's light distribution pattern by way of the adjustable sleeve cap assembly 60 of FIG. 4.

Third, adjust the external adjustable sleeve cap 63 to the desired light pattern. Fourth, tighten the set screws 69S, fixing the external adjustable sleeve cap 63 in position relative to the internal sleeve 62 for the desired light distribution pattern.

Finally, replace the lid 64 to the external adjustable sleeve cap 63 and secure the sleeve cap lid 64 thereon.

Turning now to FIG. 7 to understand this feature, a trench, as illustrated in FIG. 7*a,* is prepared to accommodate the anchor bolts 17 only two are shown due to electrical conduit 25. The anchor bolts 17 must be approximately two inches longer than the height of the base assembly 30.

A base plate 38, configured to receive the anchor bolts 17 and conduit 25, is placed such that it is level with the soil or support surface. Nuts placed on the anchor bolts, both above and below the base plate 38, are tightened against the base plate 38 such that the nuts are tight against the base plate 38. Thereafter, concrete is poured in sufficient amount to fill the trench. Once the concrete hardens, the nuts on top of the base plate 38 are removed and the base assembly 30 is set in place on top of the base plate 38. See FIG. 7*b*. Once the base assembly 30 is in place, nuts are placed onto the exposed anchor bolts 17 and tighten so as to rigidly attach the base assembly 30 to the base plate 38.

Figure 7C:
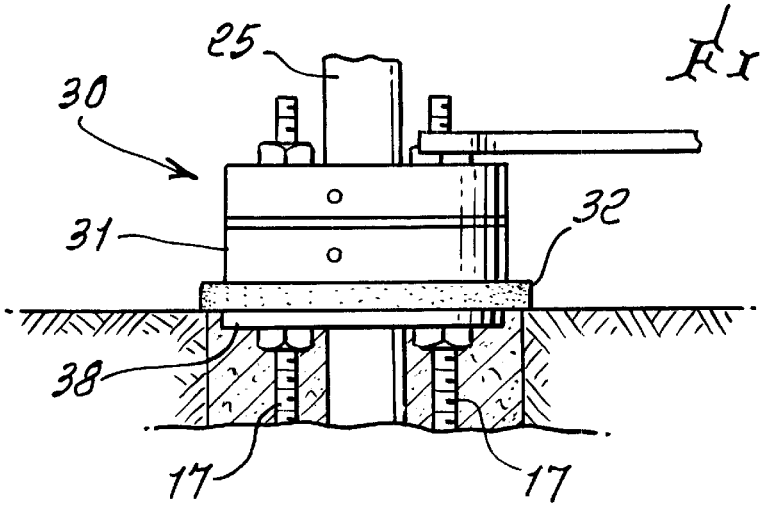

Sequentially tightening the nuts of one or more of the anchor bolts 17 compresses the neoprene base pad 32 against the base plate 38, and acts to level the fixture, FIG. 7*c*. Another advantage of the fixture of this invention is that leveling adjustment can occur after installation, when the fixture has become unlevel due to contact with another object or as a result of soil settling. Leveling of up to 2% angle correction is possible.

Each type of light assembly 40, H.I.D. FIG. 8*a* or halogen FIG. 8*b,* and its accompanying frame support 45, is designed to use the same base assembly 30, external sleeve 50, and adjustable sleeve cap assembly 60. This feature is set forth in more detail in FIG. 8 and constitutes yet another benefit of this invention wherein each type of light assembly, halogen FIG. 8*a* or H.I.D. FIG. 8*b,* can be easily exchanged for the other type light assembly, while maintaining the same external fixture appearance. To exchange lamp assemblies 40, remove the exterior sleeve 50, remove the fan screws 46S, remove the electrical connection, and remove the lamp assembly 40. Thus, the landscape designer or architect has unparalleled flexibility in designing a lighting scheme for the area to be illuminated, specifically with lighting changes in mind. Heretofore, it was economically prohibitive to design lighting theme with change in mind.

Altogether, this invention provides:

1. Effective walkway or area lighting by a bollard-type fixture.
2. Glare free lighting.
3. Selectable lighting sources, e.g., incandescent, H.I.D., halogen, or others.
4. Adjustable light distribution and full open to full closed option.
5. Weather-tight construction.
6. Easy relamping.
7. Relatively tamper proof.
8. Strength enough to withstand minor contact with foreign objects.
9. The ability to easily relevel the fixture even after installation.

FIGS. 8*a* and 8*b* also illustrate the location of the anchor bolts 17, however only two of which are shown.

The above-described embodiments of the present invention are merely descriptive of its principles and are not to be considered limiting. The scope of the present invention instead shall be determined from the scope of the following claims, including their equivalents.

We claim:

1. A bollard style light fixture, comprising:

a base a fixture body;

a light source in said body;

a light-emitting window in said body; and a cap located above said light-emitting window vertically adjustable for variably covering said light-emitting window.

2. A fixture in accordance with claim 1 wherein said cap comprises an internal sleeve and an external adjustable sleeve cap, said external adjustable sleeve cap configured to receive said internal sleeve, whereby said external adjustable sleeve cap is vertically adjustable along said internal sleeve.

3. A fixture in accordance with claim 1 comprising a base pad of resilient, compressible material and at least two anchor bolts, said fixture resting upon said base pad, said anchor bolts vertically adjustable for variably compressing the base pad and leveling of the fixture.

4. A fixture in accordance with claim 1 comprising a base pad of resilient, compressible material and at least three anchor bolts, said fixture resting upon said base pad, said anchor bolts vertically adjustable for variably compressing the base pad and leveling of the fixture.

5. A fixture in accordance with claim 2 wherein the internal sleeve includes means for fixing the position of said external adjustable sleeve cap relative to said internal sleeve.

6. A fixture in accordance with claim 1 wherein the internal sleeve is threaded and the external adjustable sleeve cap is threaded, such that the internal sleeve is threadably received by the external adjustable sleeve cap and is vertically adjustable so as to cover said light-emitting window.

7. A fixture in accordance with claim 1 wherein said internal sleeve mounts said window.

8. A fixture in accordance with claim 1 wherein the light source is interchangeable with at least two different types of light source.

9. A bollard style light fixture, comprising:

a base;

a support sleeve extending vertically from said base;

a light source located within said support sleeve;

a light-emitting window located opposite said base upon said support sleeve; and a sleeve cap located above said light-emitting window vertically adjustable for variably covering said light-emitting window.

10. A fixture in accordance with claim 9 wherein said sleeve cap comprises an internal sleeve and an external adjustable sleeve cap, said external adjustable sleeve cap configured to receive said internal sleeve, whereby said external adjustable sleeve cap is vertically adjustable along said internal sleeve.

11. A fixture in accordance with claim 9 comprising a base pad of resilient, compressible material and at least two anchor bolts, said base resting upon said base pad, said anchor bolts vertically adjustable for variably compressing the base pad and leveling the fixture.

12. A fixture in accordance with claim 9 comprising a base pad of resilient, compressible material and at least three anchor bolts, said base resting upon said base pad, said anchor bolts vertically adjustable for variably compressing the base pad and leveling the fixture.

13. A fixture in accordance with claim 9 wherein the internal sleeve includes means for fixing the position of said external adjustable sleeve cap relative to said internal sleeve.

14. A fixture in accordance with claim 9 wherein the internal sleeve is threaded and the external adjustable sleeve cap is threaded, such that the internal sleeve is threadably received by the external adjustable sleeve cap and is vertically adjustable so as to cover said light-emitting window.

15. A fixture in accordance with claim 9 wherein the light source is interchangeable with at least two different types of light source.

16. A bollard style light fixture including a base, a support, a light source, and light-emitting window wherein the improvement comprises, an internal sleeve, an external adjustable sleeve cap, said external adjustable sleeve cap is vertically adjustable along said internal sleeve, such that said external adjustable sleeve cap may be positioned to variably cover that portion of said fixture which emits light.

17. A bollard style light fixture in accordance with claim 16 wherein said internal sleeve is threaded and said external adjustable sleeve cap is threaded wherein the threaded portion of the external adjustable sleeve cap receives the threaded portion of the internal sleeve and said external adjustable sleeve cap is vertically adjustable along said threaded internal sleeve so as to cover the light-emitting window.

18. A fixture in accordance with claim 16 wherein the internal sleeve includes means for fixing the position of said external adjustable sleeve cap relative to said internal sleeve.

19. A fixture in accordance with claim 16 comprising a base pad of resilient, compressible material and at least two anchor bolts, said base rests upon said base pad, said anchor bolts vertically adjustable for variably compressing the base pad and leveling the fixture.

20. A fixture in accordance with claim 16 wherein the light source is interchangeable with at least two different types of light source.

21. A fixture in accordance with claim 16 comprising a base pad of resilient, compressible material and at least three anchor bolts, said base rests upon said base pad, said anchor bolts vertically adjustable for variably compressing the base pad and leveling the fixture.

22. A fixture in accordance with claim 3 wherein the base pad of resilient compressible material is Neoprene.

23. A fixture in accordance with claim 4 wherein the base pad of resilient compressible material is Neoprene.

24. A fixture in accordance with claim 11 wherein the base pad of resilient compressible material is Neoprene.

25. A fixture in accordance with claim 12 wherein the base pad of resilient compressible material is Neoprene.

26. A fixture in accordance with claim 19 wherein the base pad of resilient compressible material is Neoprene.

27. A fixture in accordance with claim 21 wherein the base pad of resilient compressible material is Neoprene.

* * * * *